US005569102A

United States Patent [19]

Karron

[11] Patent Number: 5,569,102

[45] Date of Patent: Oct. 29, 1996

[54] GOLF TEES

[76] Inventor: Bill Karron, 694-I Sabal Palm Cir., Altamonte Springs, Fla. 32701

[21] Appl. No.: 451,446

[22] Filed: May 26, 1995

[51] Int. Cl.[6] ..... A63B 57/00

[52] U.S. Cl. ..... 473/401; 473/387

[58] Field of Search ..... 273/33, 202–212; 138/123, 124, 125; 473/387, 389, 390, 393, 394, 396, 398, 399, 401

[56] References Cited

U.S. PATENT DOCUMENTS

| | | | |
|---|---|---|---|
| 1,251,944 | 1/1918 | Vegely | 273/209 |
| 1,858,800 | 5/1932 | Boatman | 273/33 |
| 2,285,980 | 6/1942 | Jeckel | 138/125 |
| 4,976,431 | 12/1990 | Guenther | 273/33 |
| 5,383,668 | 1/1995 | Andrikian | 273/33 |

FOREIGN PATENT DOCUMENTS

| | | | |
|---|---|---|---|
| 416334 | 9/1934 | United Kingdom | 273/33 |
| 2258161 | 2/1993 | United Kingdom | 273/33 |

*Primary Examiner*—Steven Wong

[57] ABSTRACT

A golf tee having a shank portion made of a braided plastic fabric tube, and a base portion connected to the shank portion.

22 Claims, 2 Drawing Sheets

GOLF TEES

BACKGROUND OF THE INVENTION

Field of the Invention

This invention relates to a golf tee, and more particularly a golf tee with a shank portion made of a braided plastic fabric tube.

DESCRIPTION OF BACKGROUND ART

Conventional golf tees for use on a driving range generally include a base portion 1, a cylindrical shank portion 2 and a beveled edge 3 disposed at a top portion of the cylindrical shank portion 2, as shown in FIG. 1. The conventional golf tee as shown FIG. 1 is generally made of a flexible rubber material. A disadvantage of the golf tee for use on a golf driving range as just described is that the golf tees have a useful life of approximately two weeks before they must be replaced.

Another conventional golf tee for use on a golf course is a well-known wooden or plastic golf tee which is inserted into the ground. A problem with these well-known golf tees is that they are easily broken and they are also easily lost. The broken tees contribute to a considerable amount of debris which is left on the golf course, and because the golf tees are hard to see when lying in the grass, golfers generally do not take care to find their lost or broken tees.

OBJECTS AND SUMMARY OF THE INVENTION

The present invention relates to an improved golf tee which includes a shank portion made of a braided tube.

It is an object of the present invention to provide a driving range golf tee which is highly durable and therefore provides a lifetime which exceeds that of conventional driving range golf tees.

Another object of the present invention is to provide a golf tee for use on a golf course which is highly durable and which is easy to find after the golf tee is used.

Still another object of the present invention is to provide a golf tee which is simple in structure, inexpensive to manufacture, easy to mass produce, durable in use, and refined in appearance.

These and other objects of the present invention are accomplished by a golf tee including a shank portion made of a braided tube, and a base portion connected to said shank portion. The shank portion is made of a plastic fabric which is braided into the form of a tube.

According to a first embodiment of the present invention, the base portion is formed of a flat plate having a hole therein, and the braided tube is folded inward so as to form a double layer braided tube which defines a shank portion, wherein two end portions of the braided tube are brought together and disposed in the hole of the flat plate and melted or glued to affix the two ends in the hole.

According to a second embodiment, the braided tube is folded radially inward at one end thereof to form a double layer braided tube which defines the shank portion, and the braided tube is folded radially outward twice at a second end to form a triple layer braided tube which defines the base portion.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
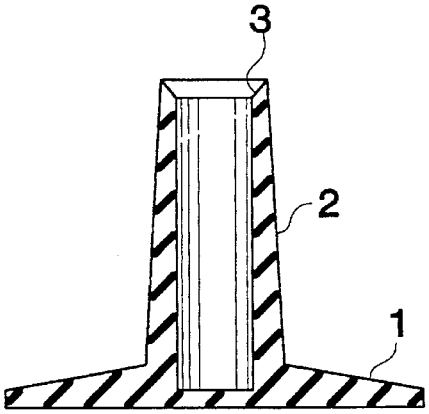
FIG. 1 PRIOR ART
FIG. 1 is a section view of a prior art golf tee for use in a golf driving range.
Figure 2A:
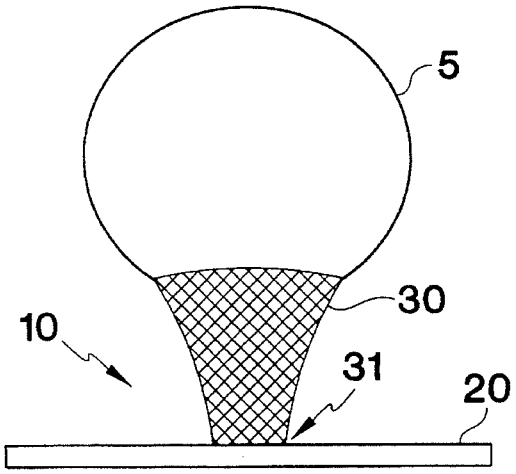
FIG. 2A is a side view of a driving range golf tee according to a first preferred embodiment of the present invention.
Figure 2B:
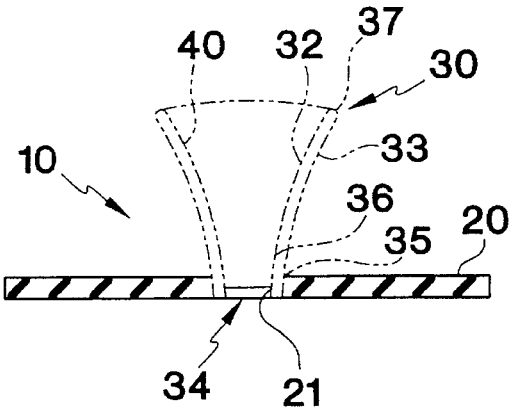
FIG. 2B is a sectional view of the driving range golf tee as shown in FIG. 2A which illustrates the double layer braided tube of the shank portion of the golf tee.
Figure 4A:
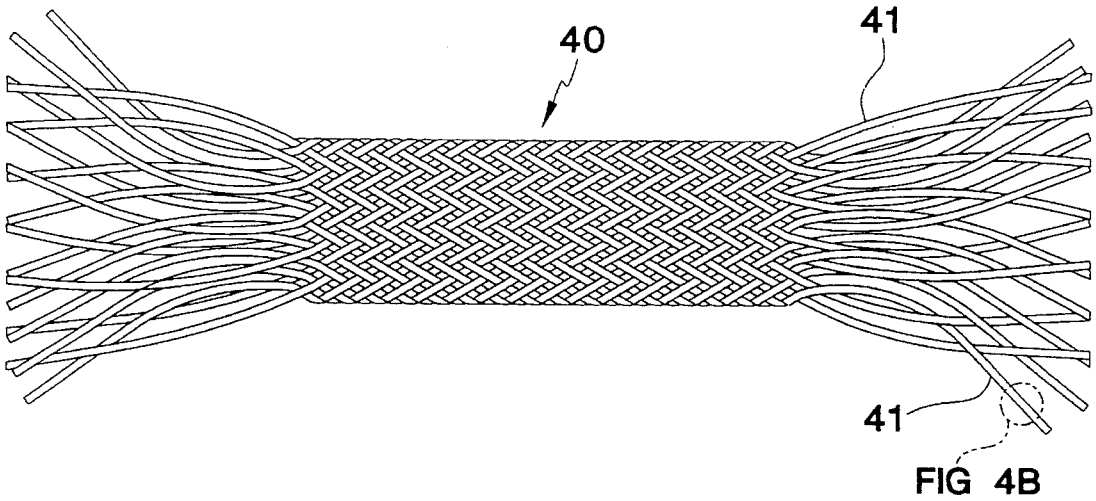
FIG. 4A illustrates a braided tube according to the present invention.

Referring in detail to the drawings and with particular reference to FIGS. 2A and 2B, a driving range golf tee 10 according to the first preferred embodiment is shown. In FIG. 2A, a base portion 20 is provided which may be made of plastic. The base portion 20 which is formed as a flat plate can be various shapes, including circular, square, triangular, rectangular or any other multi-sided shape. A shank portion 30 is connected at a lower end 31 to the base portion 20. The shank portion 30 supports a ball 5. The shank portion 30 is made of a braided tube 40 formed by a plurality of overlapping strips such as shown in FIG. 4A The shank portion has an upper end and a lower end, with each of the strips extending from the lower end to the upper end at an inclined angle with respect to a vertical axis. The shank portion may taper substantially uniformly from a first larger width dimension at the upper end to a second smaller width dimension at the lower end. As illustrated in FIG. 2B, the braided tube 40 is folded inward at a location 37 to form a double layer braided tube, including an inner shank portion 32 and an outer shank portion 33, which defines the shank portion 30. The two end portions 35,36 of the braided tube 40 are brought together and disposed in a hole 21 of the base portion 20. The ends 35,36 of the braided tube 40 can then be melted or glued in order to affix the two ends in the hole 21 of the base portion 20. As shown in FIG. 2B, material 34 may be disposed in the hole 21 interiorly of the shank portion 30 for supporting the interior of the shank portion.

The golf tee 10 as shown in FIG. 2A can be made at various heights and can be made of various colors.

The golf tee 10 has an increased durability and longer useful life than the driving range golf tee of the prior art.

Figure 3:
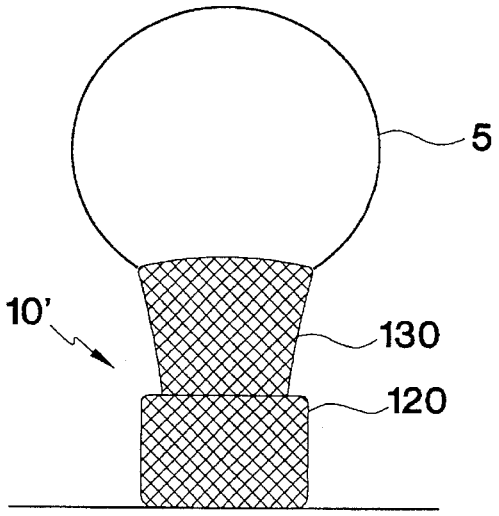
FIG. 3 is a side view of a golf tee according to a second preferred embodiment of the present invention.
Figure 5:
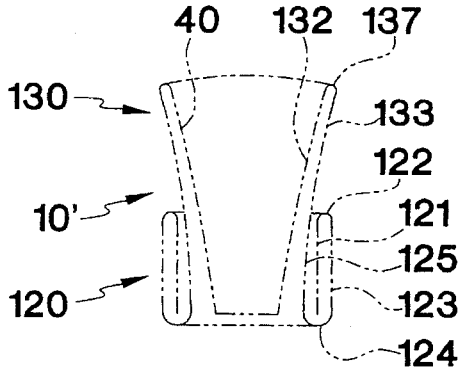
FIG. 5 illustrates the folding of the braided tube to form a double layer braided tube which defines the shank portion, and the triple layer braided tube which defines the base portion of the golf tee according to the second preferred embodiment.

Referring now in detail to the drawings and with particular reference to FIGS. 3 and 5, a golf tee 10' according to a second preferred embodiment of the present invention is shown. The golf tee 10' includes a shank portion 130 which supports a ball 5. The golf tee 10' also includes a base portion 120. The entire golf tee 10' is made of a single braided tube 40 such as shown in FIG. 4A. The braided tube 40 is folded radially inward at a first location 137 to form a double layer braided tube, including inner layer 132 and outer layer 133, which forms the shank portion 130. The braided tube 40 is also folded at a second location 122 and folded again at a third location 124 so as to define an inner layer 125, an intermediate layer 121 and an outer layer 123. The folded area at the third location 124 defines the base upon which the golf tee 10' is laid on the ground. The folded area at the first location 137 defines the location on which the golf ball 5 is placed.

Figure 4B:
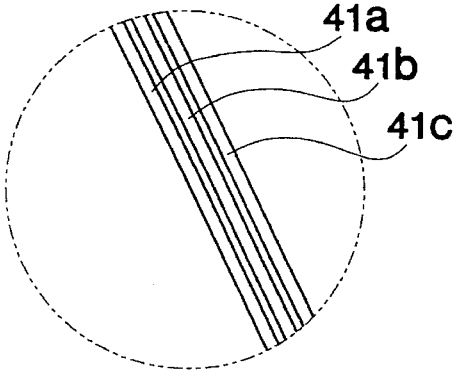
FIG. 4B is an expanded view of one of the plastic fabric strips shown in FIG. 4A.

A braided tube according to the present invention is shown in FIG. 4A. The braided tube is formed of a plurality of plastic fabric strips 41 which are braided as shown in FIG. 4A so as to form void spaces between adjacent overlapping strips. Each of the plastic fabric strips 41 include a plurality of plastic strands 41*a*, 41*b*, 41*c*, as shown in FIG. 4B.

The golf tee 10' can be made in various colors. The golf tee 10' is extremely durable and is easy to find after it is used.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A golf tee comprising:

a shank portion made of a braided tube formed by a plurality of overlapping strips, said shank portion having an upper end and a lower end, each of said strips extending from said lower end to said upper end at an inclined angle with respect to a vertical axis; and a base portion formed of a substantially flat plate connected to said lower end of said shank portion.

2. The golf tee according to claim 1, wherein said shank portion is made of a plastic fabric.

3. The golf tee according to claim 1, wherein said flat plate is made of plastic.

4. The golf tee according to claim 1, wherein said flat plate has a hole therein, and said braided tube is folded inward so as to form a double layer braided tube, and two end portions of the braided tube are brought together and disposed in said hole of said flat plate and affixed in said hole.

5. The golf tee according to claim 4, further comprising support means disposed in an interior of said shank portion at a location adjacent to said hole in said flat plate for supporting said interior of said shank portion.

6. The golf tee according to claim 1, wherein said braided tube is formed of a plurality of braided strips having void spaces formed between adjacent overlapping strips.

7. The golf tee according to claim 1, wherein said shank portion tapers from a first larger width dimension at said upper end to a second smaller width dimension at said lower end.

8. The golf tee according to claim 7, wherein said shank portion tapers substantially uniformly from said upper end to said lower end.

9. The golf tee according to claim 2, wherein said plastic fabric includes a plurality of braided plastic strips, each of said strips including a plurality of plastic strands.

10. A golf tee comprising:

a shank portion made of a braided tube; and a base portion connected to said shank portion, said base portion being formed of an extension of said braided tube which forms said shank portion;

wherein said braided tube is folded radially inward at one end thereof to form a double layer braided tube which defines said shank portion, and said braided tube is folded radially outward twice at a second end to form a triple layer braided tube which defines said base portion.

11. The golf tee according to claim 10, wherein said braided tube is made of a plastic fabric.

12. The golf tee according to claim 11, wherein said plastic fabric includes a plurality of braided plastic wherein each of said strips including a plurality of plastic strands.

13. The golf tee according to claim 10, wherein said braided tube includes a plurality of braided strips.

14. The golf tee according to claim 13, wherein each of said strips includes a plurality of strands.

15. A driving range golf tee comprising a shank portion made of a double layer plastic fabric braided tube, said braided tube being formed of a plurality of braided strips having void spaces formed between adjacent overlapping strips; and a substantially flat base portion formed of a plastic plate connected to said shank portion.

16. The golf tee according to claim 4, wherein said ends of said braided tube are affixed in said hole of said flat plate by melting said ends of said braided tube in said hole.

17. The golf tee according to claim 4, wherein said ends of said braided tube are affixed in said hole of said flat plate by gluing said ends of said braided tube in said hole.

18. The golf tee according to claim 15, wherein said shank portion tapers from a first larger width dimension at an upper end to a second smaller width dimension at a lower end.

19. The golf tee according to claim 18, wherein said shank portion tapers substantially uniformly from said upper end to said lower end.

20. The golf tee according to claim 19, wherein each of said strips includes a plurality of plastic strands.

21. The golf tee according to claim 15, wherein each of said strips includes a plurality of plastic strands.

22. The golf tee according to claim 15, further comprising support means disposed in an interior of said shank portion at a location adjacent to said hole in said flat plate for supporting said interior of said shank portion.

* * * * *